US012203269B2

(12) United States Patent
Verhey

(10) Patent No.: US 12,203,269 B2
(45) Date of Patent: Jan. 21, 2025

(54) PREFABRICATED STRUCTURAL REINFORCEMENTS

(71) Applicant: WALTERS INC., Hamilton (CA)

(72) Inventor: Timothy Verhey, Ancaster (CA)

( * ) Notice: Subject to any disclaimer, the term of this patent is extended or adjusted under 35 U.S.C. 154(b) by 0 days.

(21) Appl. No.: 17/347,439

(22) Filed: Jun. 14, 2021

(65) Prior Publication Data

US 2021/0301531 A1 Sep. 30, 2021

Related U.S. Application Data

(62) Division of application No. 16/405,828, filed on May 7, 2019, now Pat. No. 11,060,287.

(51) Int. Cl.
*E04C 5/06* (2006.01)

(52) U.S. Cl.
CPC ..... *E04C 5/0627* (2013.01); *E04C 5/0604* (2013.01)

(58) Field of Classification Search
CPC ..... E04C 5/0627; E04C 5/0604; E04B 1/215
See application file for complete search history.

(56) References Cited

U.S. PATENT DOCUMENTS 1,911,957 A ‡ 5/1933 Kassmir ..... E04C 5/18 52/687
4,280,310 A ‡ 7/1981 Tolliver ..... E04C 5/0609 52/646
5,392,580 A ‡ 2/1995 Baumann ..... B21F 27/125 52/646
5,473,850 A * 12/1995 Balding ..... E04B 2/8629 52/439
8,375,678 B1 ‡ 2/2013 Ferrer ..... E04C 5/165 52/745.17
8,381,479 B1 ‡ 2/2013 Ferrer ..... E04C 5/0604 52/649.3
9,267,287 B1 ‡ 2/2016 Bongiorno ..... E04C 5/0604
9,284,744 B2 ‡ 3/2016 Patterson ..... E04H 12/2261
9,890,545 B1 * 2/2018 Bongiorno ..... E04C 5/0618
9,915,068 B2 ‡ 3/2018 Kim ..... E04G 21/142
10,301,838 B1 ‡ 5/2019 Karakas ..... E04C 5/0609
11,060,287 B2 * 7/2021 Verhey ..... E04C 3/34
2015/0113886 A1 * 4/2015 Chang ..... E04C 5/168 52/745.19
2016/0017591 A1 * 1/2016 Miyasaka ..... E04C 3/34 52/167.1
2016/0251856 A1 ‡ 9/2016 Kim ..... E04C 3/34 52/231
2017/0191268 A1 * 7/2017 LaFauci ..... E04C 3/34
2018/0171627 A1 * 6/2018 Carrion ..... E04C 2/06
2018/0320363 A1 * 11/2018 Hong ..... E04C 5/0645
2021/0301531 A1 * 9/2021 Verhey ..... E04C 3/34

FOREIGN PATENT DOCUMENTS

CN 102966093 ‡ 2/2013

* cited by examiner
‡ imported from a related application

*Primary Examiner* — Andrew J Triggs
(74) *Attorney, Agent, or Firm* — Jenna L. Wilson; Wilson Lue LLP

(57) ABSTRACT

A system for providing reinforcement to structures comprises a prefabricated rebar assembly, a first end plate and a second end plate. The prefabricated rebar assembly comprises multiple rods connected to each other. The prefabricated rebar assembly is held between the first end plate and the second end plate to form a block of rebar assembly.

13 Claims, 10 Drawing Sheets

PREFABRICATED STRUCTURAL REINFORCEMENTS

BACKGROUND

Field of the Invention

The subject matter in general relates to construction technologies. More particularly, the subject matter relates to prefabricated structural members used in composite construction.

Description of Related Art

Steel members are one of the most important elements used in the construction of framed buildings. These members can be composite members which are structural steel members that are generally formed and filled with concrete to form a stable composite structure.

Conventionally, steel reinforcement within composite structural members comprise multiple steel reinforcing steel rods held together using reinforcing steel ties or other means to form reinforcing steel cages. Typically reinforcing steel is installed at the construction site. This takes up a lot of space at the construction site and takes up a lot of construction time to complete. Considering the ever-growing need for residential and commercial buildings, cities are already cramped for space to build buildings, let alone space for constructing reinforcing cages at the site of construction.

Further, there is a dearth of skilled labours in the construction industry who can place the reinforcing steel at the required place during the construction program. Additionally, as the height of construction increases, the placement of reinforcing steel becomes logistically more challenging. Conventionally, the reinforcing steel cages are nested on top of each other as the height of construction increases. This again requires skilled labour and time. All of this contributes to increase in expenditure.

Considering the foregoing discussion there is a need for an improved system for providing reinforcing steel to composite steel and concrete structures.

SUMMARY

In an embodiment, disclosed is a system for providing reinforcement to structures. The system comprises a prefabricated rebar assembly, a first end plate and a second end plate. The prefabricated rebar assembly comprises multiple rods connected to each other. The prefabricated rebar assembly is held between the first end plate and the second end plate to form a block of rebar assembly, or cage.

In one aspect of the invention, each of the first end plate and the second end plate comprises peripheral edges, wherein a series of passage holes are defined along the peripheral edges.

In another aspect of the invention, each of the first end plate and the second end plate comprises a series of pass-through members, wherein, the pass-through members define the passage holes; and the pass-through members are coupled to the peripheral edges to laterally extend beyond the peripheral edges.

In another aspect of the invention, the system further includes outer reinforcing bars, wherein each of the outer reinforcing bars is received by one of the passage holes in the first end plate and one of the passage holes of the second end plate.

In another aspect of the invention, a surface of the first end plate facing the second end plate comprises a first arrangement to indicate locations on the first end plate at which reinforcement rods extending from the first end plate towards the second end plate must be coupled to the first end plate; and a surface of the second end plate facing the first end plate comprises a second arrangement to indicate location on the second end plate at which reinforcement rods extending from the second end plate towards the first end plate must be coupled to the second end plate.

In another aspect of the invention, a surface of the first end plate facing away from the second end plate comprises a third arrangement to indicate locations on the first end plate at which reinforcement rods extending from the first end plate away from the second end plate must be coupled to the first end plate; and a surface of the second end plate facing away from the first end plate comprises a fourth arrangement to indicate location on the second end plate at which reinforcement rods extending from the second end plate away from the first end plate must be coupled to the second end plate.

In another aspect of the invention, the first arrangement and the second arrangement comprise a series of grooves defined on the surface of the first end plate and the second end plate.

In another aspect of the invention, the first arrangement and the second arrangement comprise a series of protrusions extending from the surface of the first end plate and the second end plate.

In another aspect of the invention, the protrusions are U-shaped members coupled to the surface of the first end plate and the second end plate.

In another aspect of the invention, each of the first end plate and the second end plate defines a set of connector holes, wherein each of the connector holes are configured to receive a connecting member, wherein the connecting member is configured to connect a first of the block of rebar assembly with a second of the block of rebar assembly.

In another aspect of the invention, the second end plate of the first of the block of rebar assembly and the first end plate of the second of the block of rebar assembly are connected to each other using the connecting member.

In another aspect of the invention, each of the first end plate and the second end plate defines a set of flow holes, wherein the flow holes are configured to allow passage of concrete between a first of the block of rebar assembly and a second of the block of rebar assembly.

In another aspect of the invention, the first end plate can be larger compared to the second end plate if the completed structural members reduce in size.

According to a second embodiment of the invention, there is provided a method for providing reinforcement to structures, the method including the steps of: prefabricating a rebar assembly comprising multiple rods, installing that rebar assembly and positioning the prefabricated rebar assembly by disposing it between a first end plate and a second end plate to form a block of rebar assembly, transporting the prefabricated assembly to the construction site, installing said assembly, then pouring concrete into the block of rebar assembly.

In various other aspect of the second embodiment, the rebar assembly is as herein described.

BRIEF DESCRIPTION OF DRAWINGS

Embodiments are illustrated by way of example and not limitation in the figures of the accompanying drawings, in which like references indicate similar elements and in which.

DETAILED DESCRIPTION

The following detailed description includes references to the accompanying drawings, which form a part of the detailed description. The drawings show illustrations in accordance with example embodiments. These example embodiments, which may be herein also referred to as "examples" are described in enough detail to enable those skilled in the art to practice the present subject matter. However, it may be apparent to one with ordinary skill in the art, that the present invention may be practised without these specific details. In other instances, well-known methods, procedures and components have not been described in detail so as not to unnecessarily obscure aspects of the embodiments. The embodiments can be combined, other embodiments can be utilized, or structural, logical, and design changes can be made without departing from the scope of the claims. The following detailed description is, therefore, not to be taken in a limiting sense, and the scope is defined by the appended claims and their equivalents.

In this document, the terms "a" or "an" are used, as is common in patent documents, to include one or more than one. In this document, the term "or" is used to refer to a nonexclusive "or," such that "A or B" includes "A but not B," "B but not A," and "A and B," unless otherwise indicated.

Overview

A system is disclosed for providing reinforcements to structures. The system comprises a prefabricated rebar assembly comprising multiple rods connected to each other. This prefabricated rebar assembly is held between a first end plate and a second end plate to form a block. A series of pass-through members are arranged along the peripheral edges and within the body of the first end plate and the second end plate to accommodate inner and outer reinforcing continuity bars. A U-shaped protrusion is defined on surface of the first end plate and the second end plate that acts as an indicator as to where the multiple rods of the rebar assembly are to be placed. Multiple blocks of rebar assembly are connected to each other using connecting members. The end plates define a set of connector holes to receive the connecting continuity members as well as structural bolts. Concrete flows between two blocks of rebar assembly, that are connected to each other, via flow holes defined on the end plates.

System for Providing Reinforcement to Structures

Figure 1:
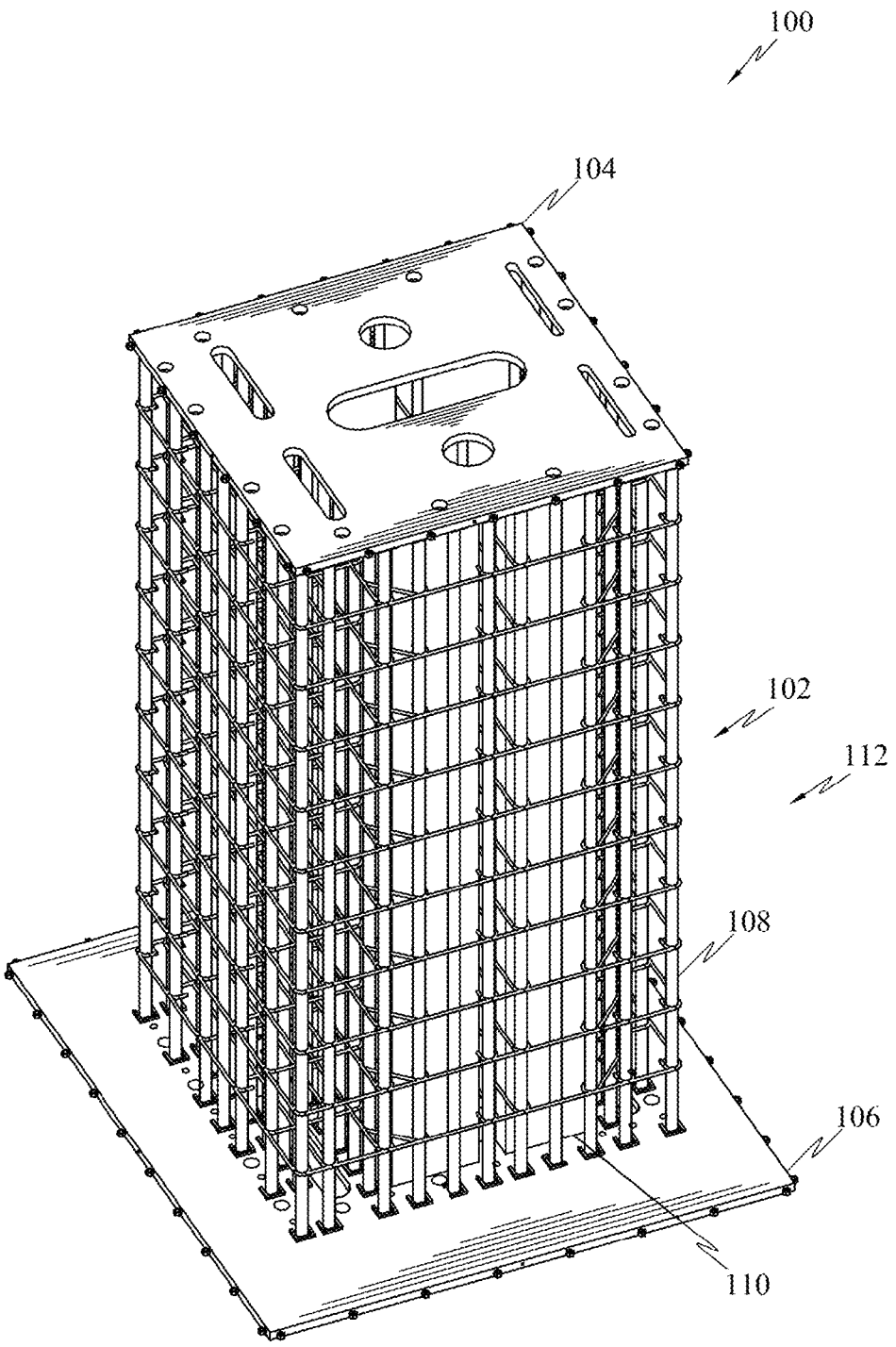
FIG. 1 illustrates a system for providing reinforcement to structures, in accordance with an embodiment.

Referring to FIG. 1, a system 100 is disclosed for providing reinforcement to structures, in accordance with an embodiment. The system 100 comprises a prefabricated rebar assembly 102, a first end plate 104 and a second end plate 106. The prefabricated rebar assembly 102 comprises multiple rods 108 (steel rods 108 or reinforcement rods 108) connected to each other. The rods 108 may be connected to each other using rods 108 or other connecting rods. The rebar assembly 102 may be in the shape of the structure to which the rebar assembly provides reinforcement. As an example, if the structure is a circular column, the rebar assembly 102 may be circular in shape. Alternatively, if the structure is a rectangular column, the rebar assembly 102 may be rectangular in shape.

In an embodiment, the rebar assembly 102 may comprise solid columns 110 to provide strength to the structure. The rebar assembly 102 may be held between the end plates 104, 106 to form a block or cage 112.

In an embodiment, the first end plate 104 may be larger than the second end plate 106 or conversely, the second end plate 106 may be larger than the first end plate 104. The end plates 104, 106 may assume the shape of the structure to which it is being reinforced. As an example, the end plates 104, 106 may be circular or rectangular in shape.

Figure 2A:
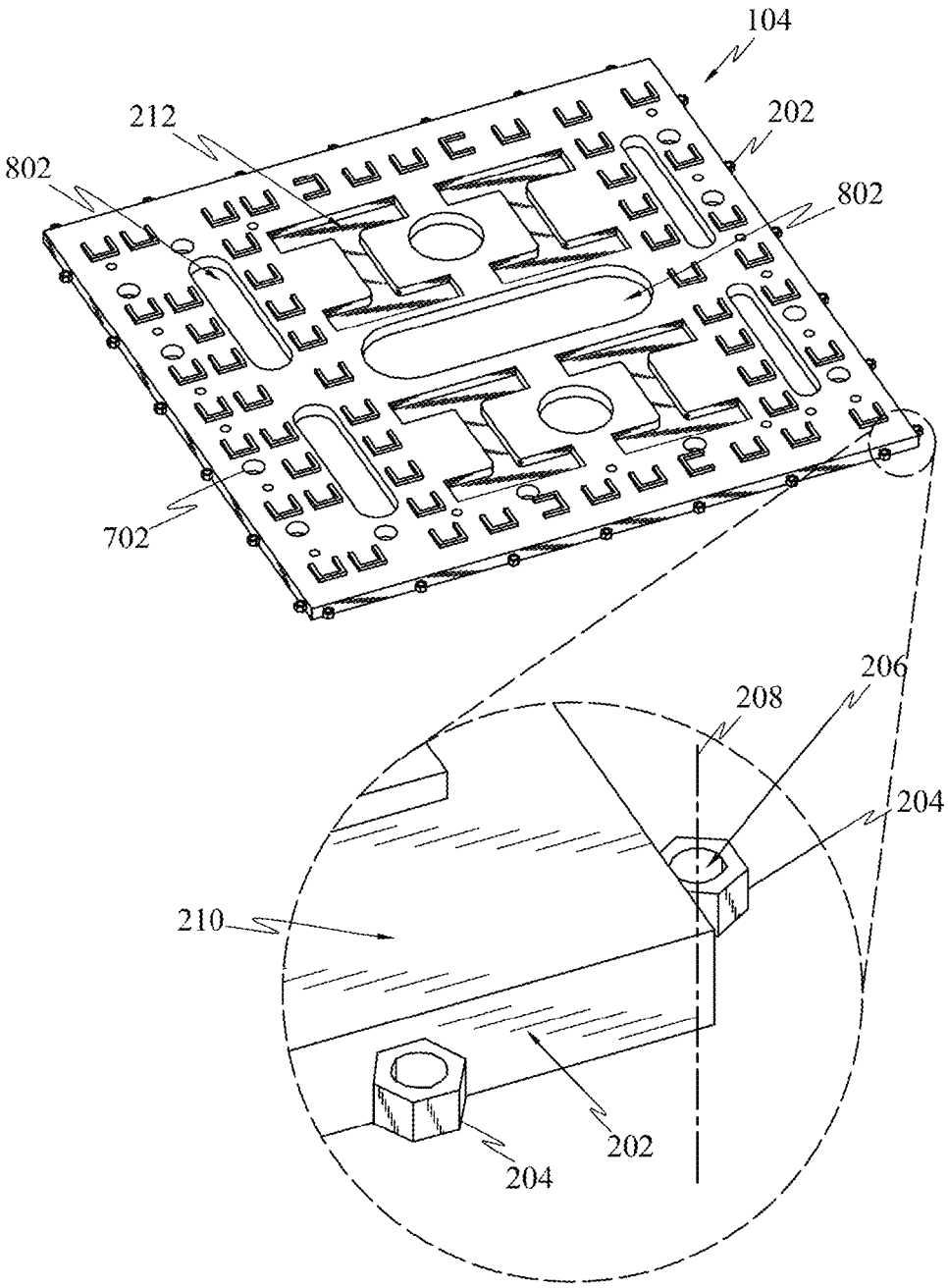
FIGS. 2A and 2B represent isometric views of the first end plate and the second end plate along with pass-through members, connector holes and flow holes, in accordance with an embodiment.
Figure 2B:
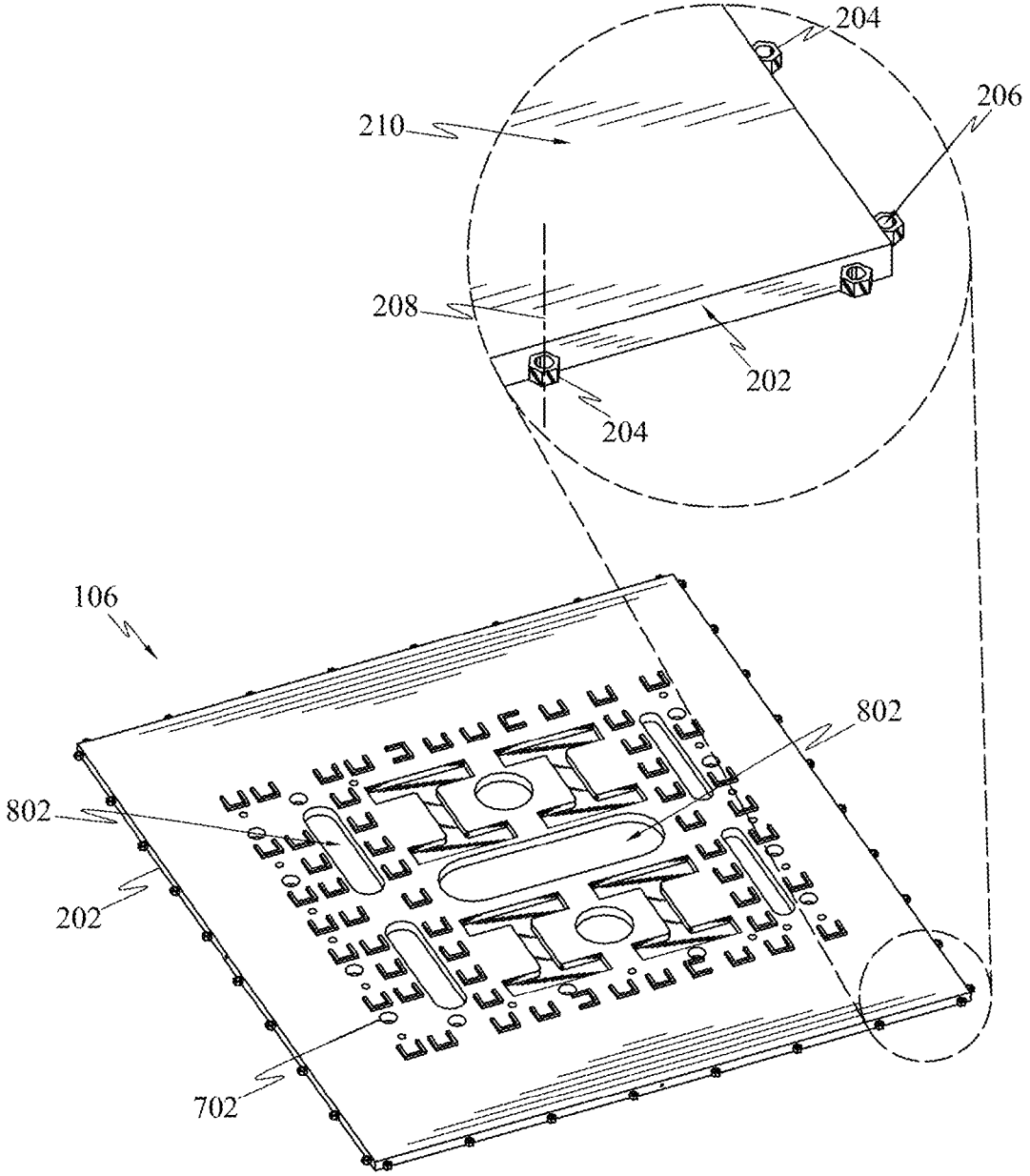

FIGS. 2A and 2B represent isometric views of the first end plate 104 and the second end plate 106, in accordance with an embodiment. Peripheral edges 202 of the end plates 104, 106 comprise a series of pass-through members 204, wherein each pass-through member 204 defines a passage hole 206. These pass-through members 204 are arranged such that they extend laterally beyond the peripheral edges 202 of the end plates 104, 106. In an embodiment, longitudinal axis 208 of the pass-through member 204 may be perpendicular to surface 210 of the end plates 104, 106.

In an embodiment, the end plates 104, 106 may define grooves 212 to indicate placement of the solid columns 110. The solid columns 110 may be universal columns 110 and the corresponding grooves 212 may be in the shape of an "I".

Figure 3:
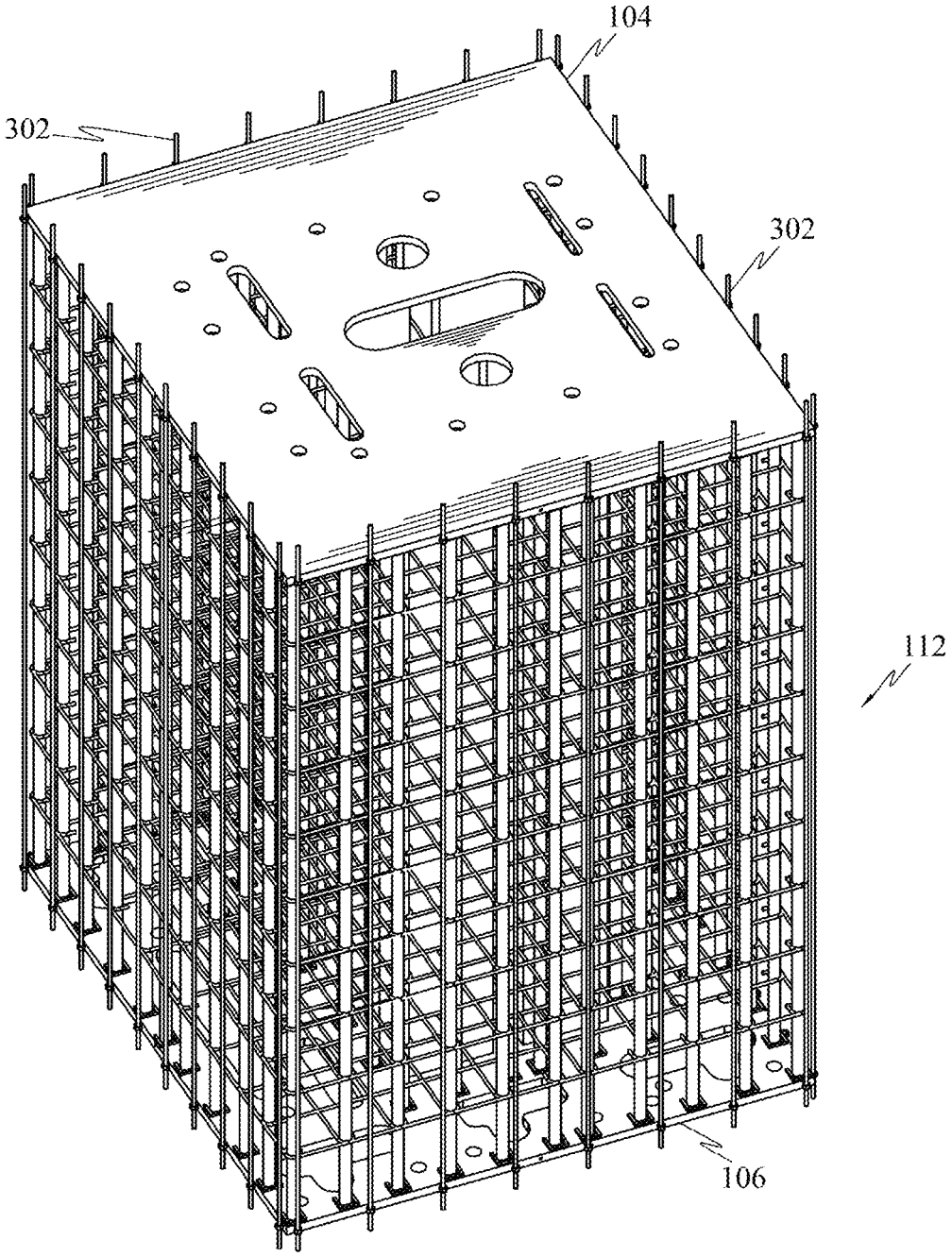
FIG. 3 illustrates the end plates along with outer reinforcing bars, in accordance with an embodiment.

FIG. 3 discloses the end plates 104, 106 along with outer reinforcing bars 302, in accordance with an embodiment. The outer reinforcing bars 302 are passed through the passage holes 206 of the end plates 104, 106. A single outer reinforcing bar 302 may be passed through the pass-through member 204 of the first end plate 104 and the corresponding pass-through member 204 of the second end plate 106. The outer reinforcing bars 302 may be used to protect concrete from spalling off the edges of the block of rebar assembly 112.

In an embodiment, two or more reinforcing bars 302 may be coupled to form a single continuing bar, and passed through the passage holes 206, as explained earlier. As an example, if the distance between the first end plate 104 and the second end plate 106 within the block of rebar assembly 112 is greater than the length of a single reinforcing bar 302, then two or more reinforcing bars 302 may be tied together.

Figure 4:
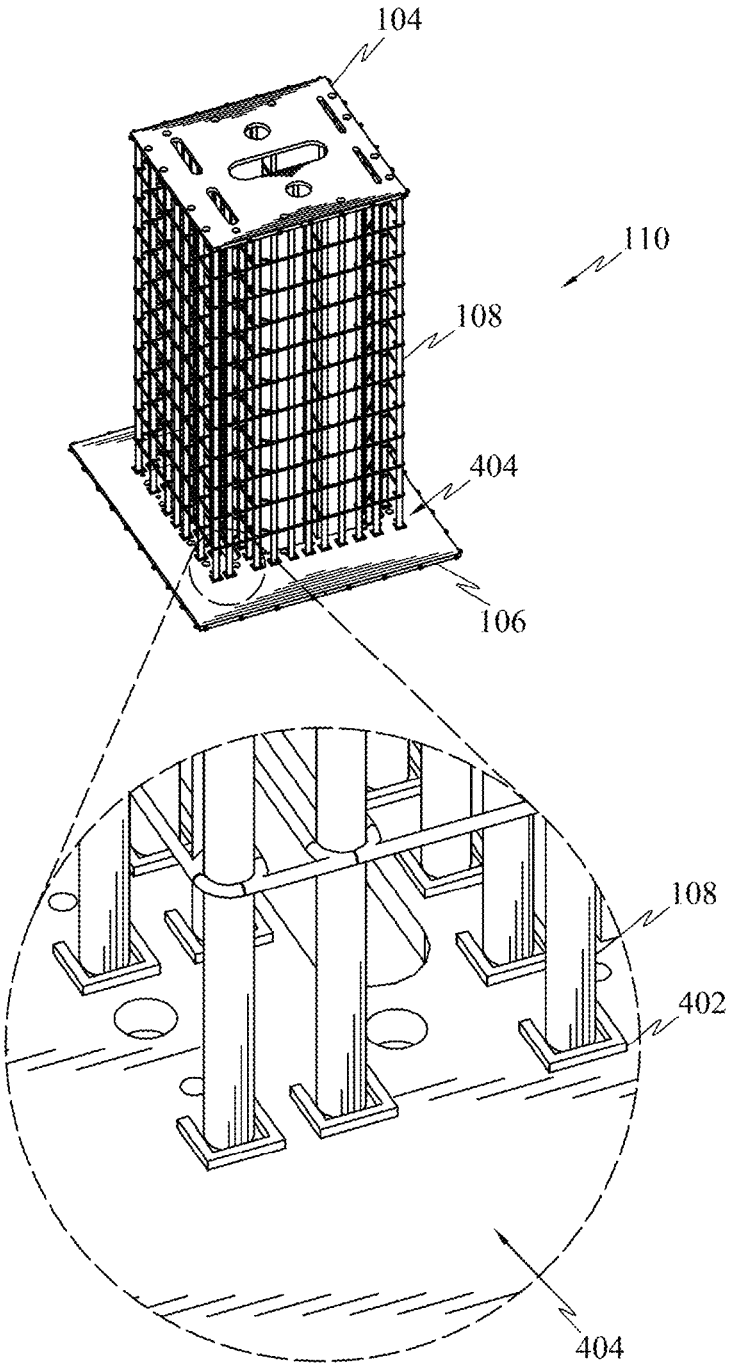
FIG. 4 illustrates an isometric view of coupling reinforcement rods to the end plates, in accordance with an embodiment.

FIG. 4 illustrates an isometric view of coupling or engaging the reinforcement rods 108 to the end plates 104, 106 using arrangements 402, in accordance with an embodiment. Inner surface 404 of the end plates 104, 106 within the block of rebar assembly 110 may comprise arrangements 402 (may be termed as first arrangement 402 for the first end plate 104 and second arrangement 402 for the second end plate 106). The arrangements 402 may indicate locations at which the reinforcement rods 108 may extend between the first end plate 104 and the second end plate 106.

The arrangement 402 may be a protrusion 402 that may be arranged on the inner surface 404 of the end plates 104, 106. The protrusion 402 may be a U-shaped member 402 coupled to the inner surface 404 of the end plates 104, 106. One end of the reinforcement rod 108 may be coupled to the U-shaped member 402 in the first end plate 104 and other end of the reinforcement rod 108 may be coupled to the corresponding U-shaped member 402 in the second end plate 106.

In another embodiment, a first reinforcement rod 108 may be coupled to the U-shaped member 402 of the first end plate 104 and a second reinforcement rod 108 may be coupled to the U-shaped member 402 of the second end plate 106. The two reinforcement rods 108 may be tied together to form a single reinforcement rod 108.

Figure 5:
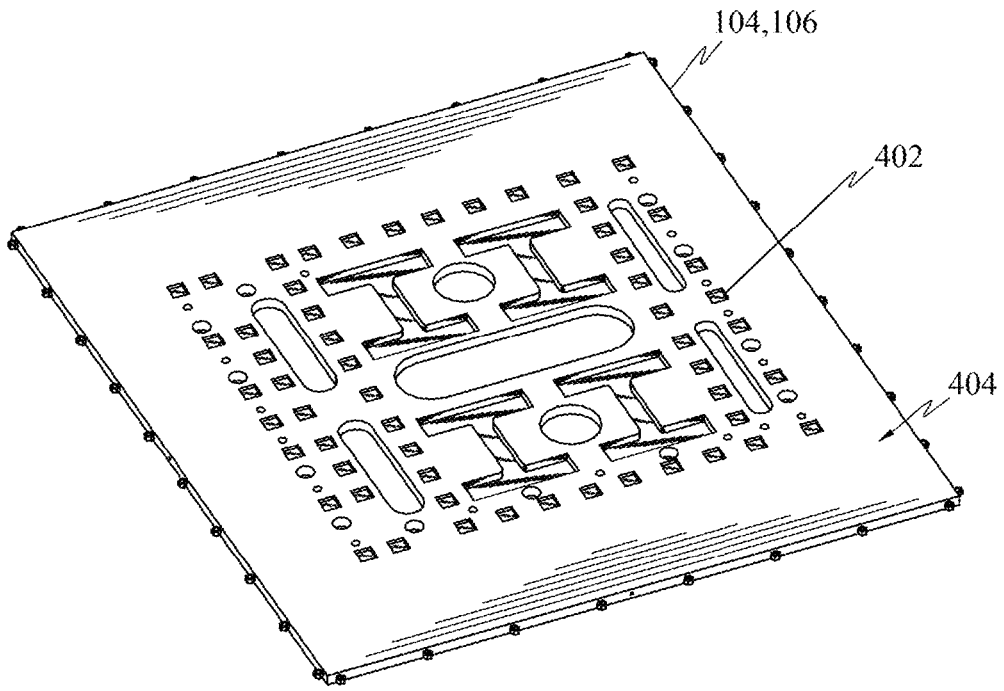
FIG. 5 illustrates an embodiment of the arrangement.

FIG. 5 illustrates an alternate embodiment of the arrangement 402. The arrangement 402 may be a series of grooves 402 that may be defined on the inner surface 404 of the end plates 104, 106. One end of the reinforcement rod 108 may be placed in the groove 402 defined by the first end plate 104 and other end of the reinforcement rod 108 may be placed in the corresponding groove 402 defined by the second end plate 106.

Figure 6:
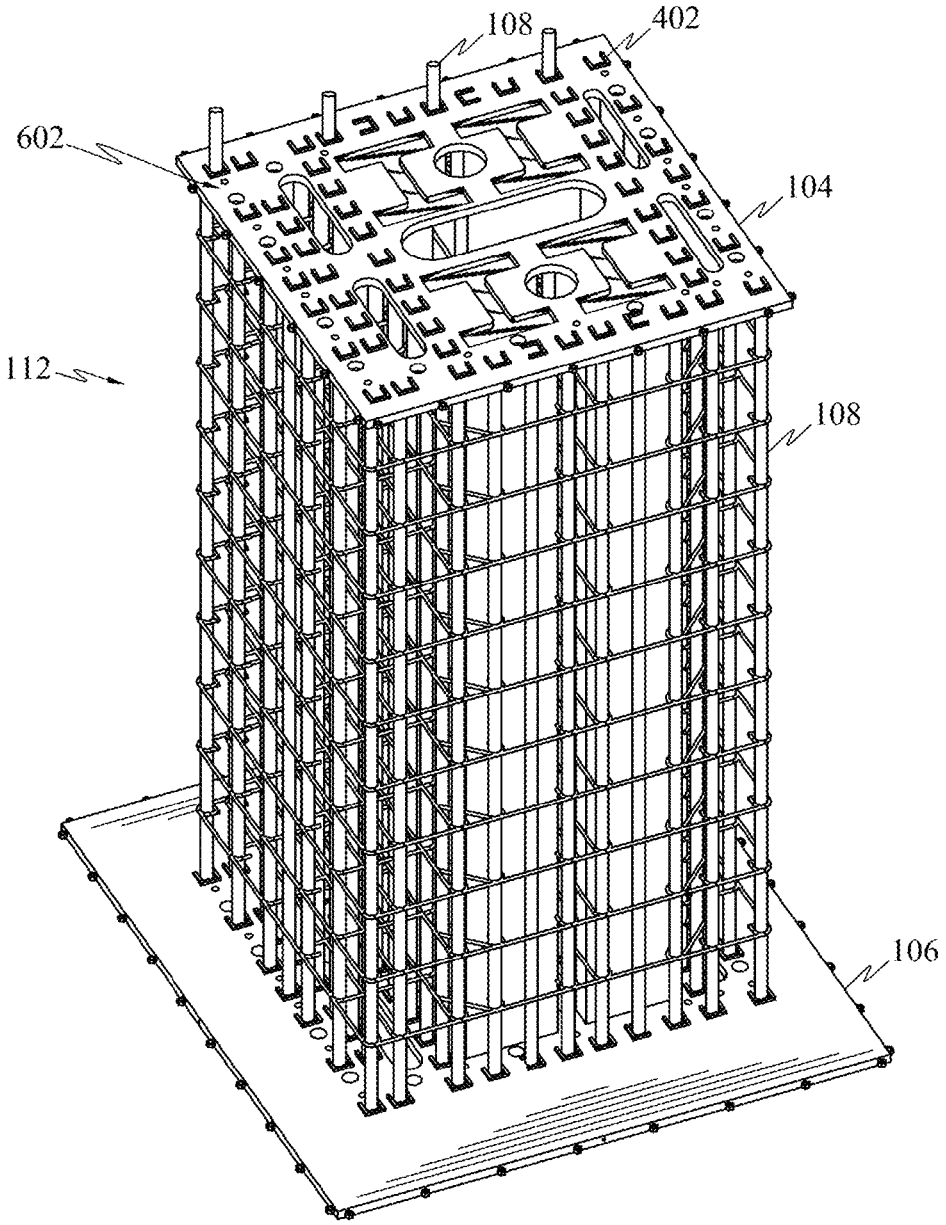
FIG. 6 illustrates an alternate embodiment of the arrangement.

FIG. 6 illustrates an alternate embodiment of the arrangement 402. Outer surface 602 of one or more of the end plates 104, 106 may comprise arrangements 402 (may be termed as third arrangement 402 for the first end plate 104 and fourth arrangement 402 for the second end plate 106). The arrangements 402 may indicate locations at which the reinforcement rods 108 may extend, outside of the rebar assembly block 112, from the first end plate 104 and the second end plate 106.

Figure 7:
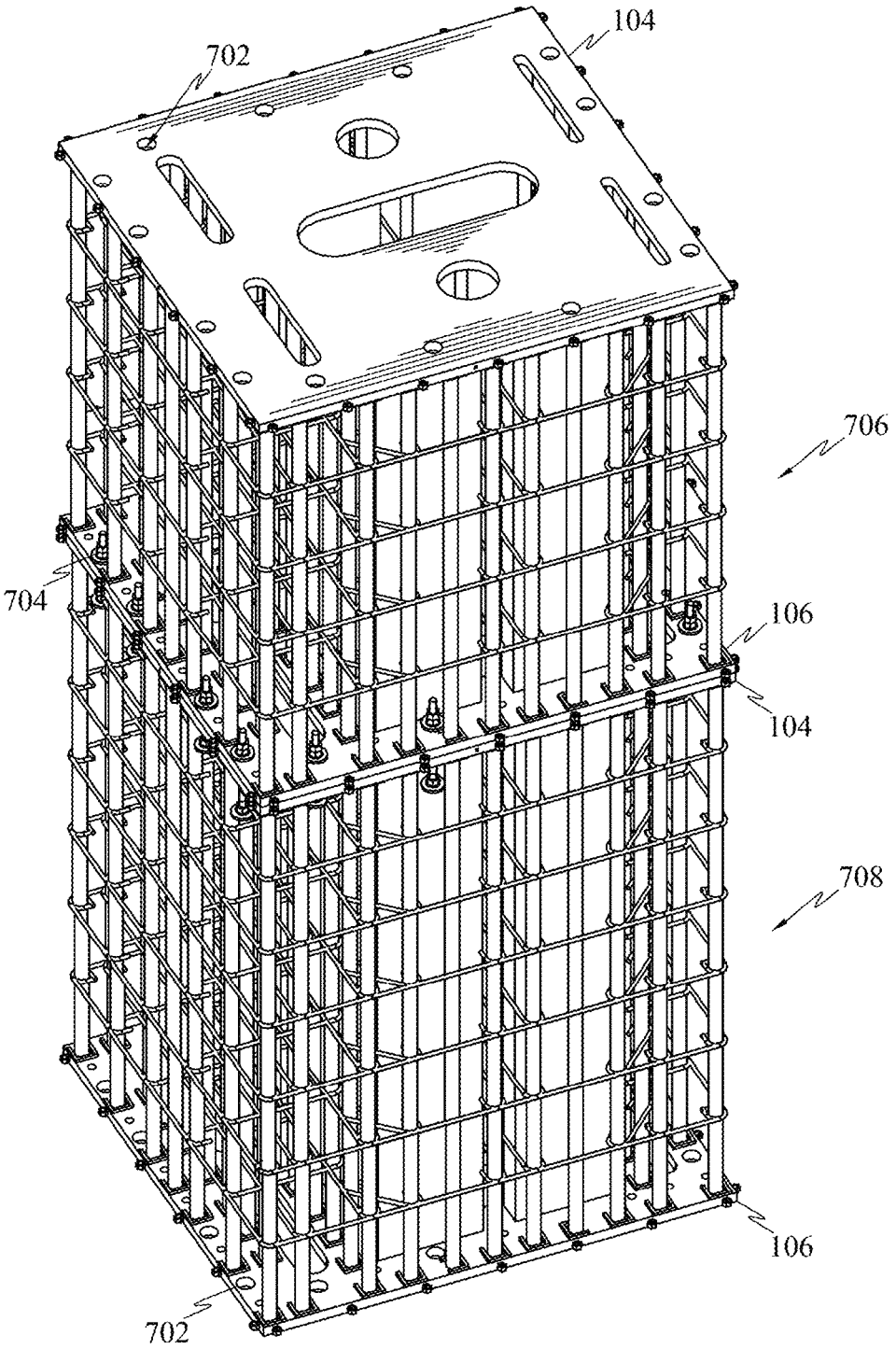
FIG. 7 illustrates an isometric view of two blocks of rebar assembly connected to each other using connecting member, in accordance with an embodiment.

Referring to FIGS. 2A, 2B and 7, the first end plate 104 and the second end plate 106 may define the connector holes 702, wherein the connector holes 702 may be configured to receive a connecting member 704. The connecting member 704 may be used to connect first block of rebar assembly 706 to a second block of rebar assembly 708. The second end plate 106 of the first block of rebar assembly 706 and the first end plate 104 of the second block of rebar assembly 708 are connected to each other using the connecting member 704.

In an embodiment, the connector hole 702 may be internally threaded and the connecting member 704 may be a screw to connect the two end plates 104, 106.

In another embodiment, the connecting member 704 may be a nut and bolt mechanism or any other connecting mechanism that may exist in the art.

Referring to FIGS. 2A and 2B, the first end plate 104 and the second end plate 106 may define flow holes 802. The flow holes 802 may be of different shapes and sizes. The flow holes 802 may allow passage of concrete between the first block of rebar assembly 706 and the second block of rebar assembly 708.

Figure 8:
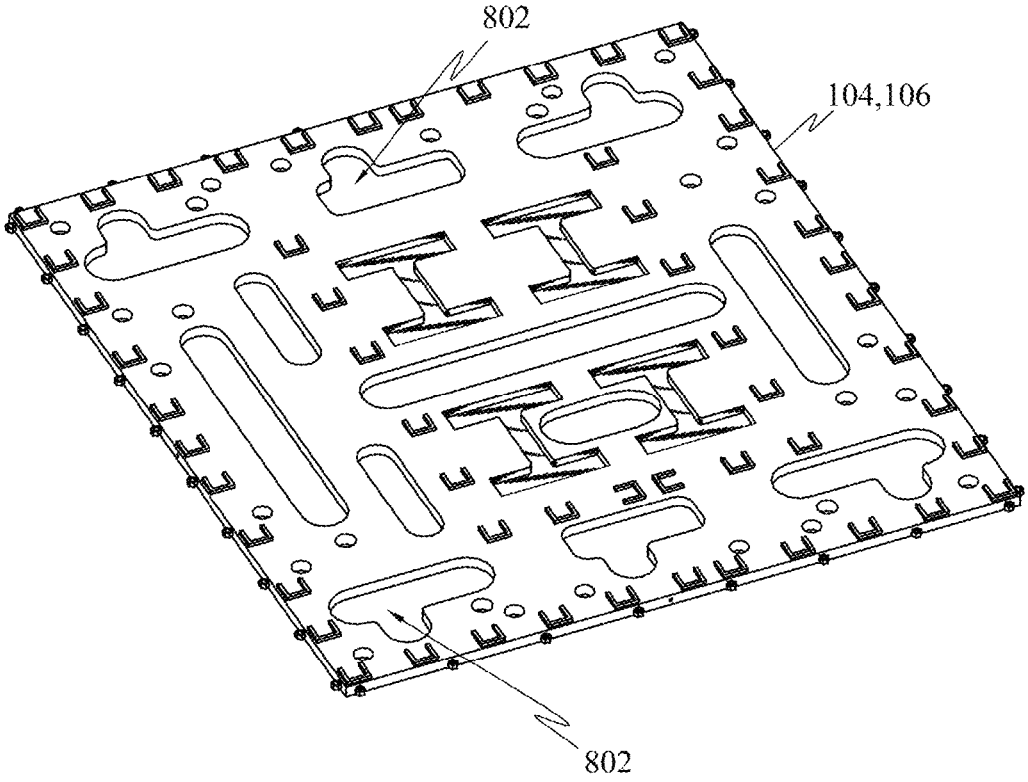
FIG. 8 is an alternate embodiment of the flow hole.

Referring to FIG. 8, an alternate embodiment of the flow holes 802 is shown.

Figure 9:
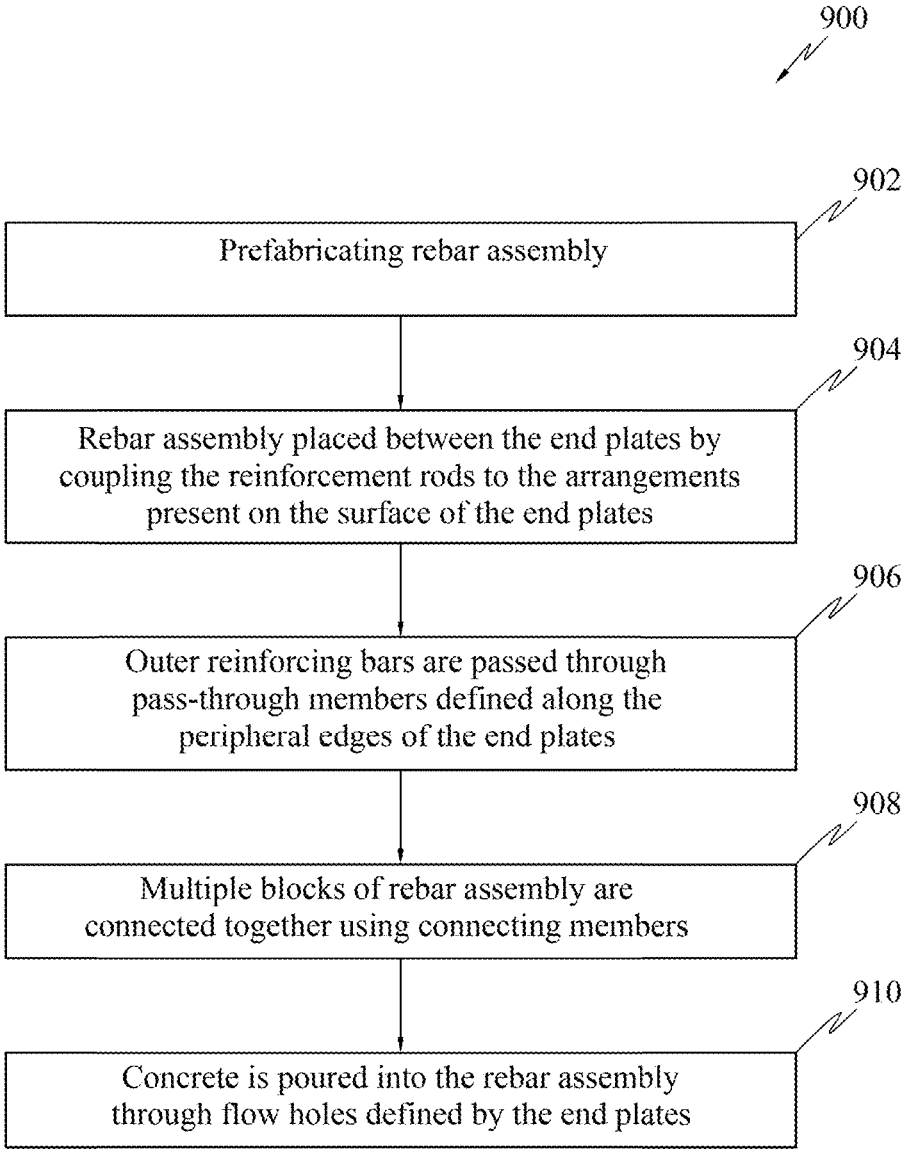
FIG. 9 is a flowchart for providing reinforcement to structures, in accordance with an embodiment.

FIG. 9 is a flowchart for providing reinforcement to structures, in accordance with an embodiment. At step 902, the prefabricated rebar assembly 102 created as herein described. The prefabricated rebar assembly 102 comprises multiple rods 108 (steel rods 108 or reinforcement rods 108) connected to each other.

At step 904, the prefabricated rebar assembly 102 may be placed between the first end plate 104 and the second end plate 106 to form the block of rebar assembly 112. The inner surface 404 of the end plates 104, 106 within the block of rebar assembly 110 may comprise arrangements 402 to indicate locations at which the reinforcement rods 108 may be placed.

In an embodiment, the arrangement 402 may be a protrusion 402 that may be arranged on the inner surface 404 of the end plates 104, 106. The protrusion 402 may be a U-shaped member 402 coupled to the inner surface 404 of the end plates 104, 106. One end of the reinforcement rod 108 may be coupled to the U-shaped member 402 in the first end plate 104 and other end of the reinforcement rod 108 may be coupled to the corresponding U-shaped member 402 in the second end plate 106.

At step 906, the outer reinforcing bars 302 may be passed through the pass-through members 204 of the first end plate 104 and the corresponding pass-through members 204 of the second end plate 106. The pass-through members 204 may be arranged along the peripheral edges 202 of the end plates 104, 106 such that pass-through members 204 extend laterally beyond the peripheral edges 202 of the end plates 104, 106. Each pass-through member 204 defines a passage hole 206 through which the outer reinforcing bars 302 may pass through.

The outer reinforcing bars 302 may be used to protect concrete from spalling off the edges of the block of rebar assembly 112.

At step 908, multiple blocks of rebar assembly 706, 708 may be connected to each other using connecting members 704. The end plates 104, 106 may define the connector holes 702, wherein the connector holes 702 may be configured to receive the connecting member 704.

At step 910, concrete may be poured into the block of rebar assembly 112 using flow holes 802 defined by the end plates 104, 106.

It shall be noted that the processes described above are described as sequence of steps; this was done solely for the sake of illustration. Accordingly, it is contemplated that some steps may be added, some steps may be omitted, the order of the steps may be re-arranged, or some steps may be performed simultaneously.

Although embodiments have been described with reference to specific example embodiments, it will be evident that various modifications and changes may be made to these embodiments without departing from the broader spirit and scope of the system and method described herein. Accordingly, the specification and drawings are to be regarded in an illustrative rather than a restrictive sense.

Many alterations and modifications of the present invention will no doubt become apparent to a person of ordinary skill in the art after having read the foregoing description. It is to be understood that the phraseology or terminology employed herein is for the purpose of description and not of limitation. It is to be understood that the description above contains many specifications; these should not be construed as limiting the scope of the invention but as merely providing illustrations of some of the personally preferred embodiments of this invention. Thus, the scope of the invention should be determined by the appended claims and their legal equivalents rather than by the examples given.

What is claimed is:

1. A system for providing reinforcement to structures, the system comprising:

a rebar assembly comprising multiple reinforcement rods connected to each other;

a first end plate; and a second end plate, wherein the rebar assembly is held between the first end plate and the second end plate and within a periphery of the first end plate and a periphery of the second end plate such that ends of the reinforcement rods are engaged on the first end plate and second end plate to form a block of rebar assembly, wherein the first end plate comprises a plurality of pass-through members projecting beyond the periphery of the first end plate to define a plurality of passage holes beyond the periphery of the first end plate, and the second end plate comprises a plurality of pass-through members projecting beyond the periphery of the second end plate to define a plurality of passage holes beyond the periphery of the second end plate, the plurality of passage holes of the first end plate and the second end plate for receiving outer reinforcing bars;

each of the first end plate and the second end plate defining a set of flow holes to permit passage of concrete through the first end plate and into a second end plate of an adjacent block of rebar assembly and a first end plate of the adjacent block of rebar assembly.

2. The system as claimed in claim 1, further comprising the outer reinforcing bars, wherein each of the outer reinforcing bars is received by one of the passage holes in the first end plate and one of the passage holes of the second end plate.

3. The system as claimed in claim 1, wherein, a surface of the first end plate facing the second end plate comprises a first arrangement to indicate locations on the first end plate at which reinforcement rods extending from the first end plate towards the second end plate are couplable to the first end plate; and a surface of the second end plate facing the first end plate comprises a second arrangement to indicate locations on the second end plate at which reinforcement rods extending from the second end plate towards the first end plate are couplable to the second end plate.

4. The system as claimed in claim 3, wherein, a surface of the first end plate facing away from the second end plate comprises a third arrangement to indicate locations on the first end plate at which reinforcement rods extending from the first end plate away from the second end plate are coupleable to the first end plate; and a surface of the second end plate facing away from the first end plate comprises a fourth arrangement to indicate locations on the second end plate at which reinforcement rods extending from the second end plate away from the first end plate are coupleable to the second end plate.

5. The system as claimed in claim 3, wherein the first arrangement and the second arrangement comprise a series of grooves defined on the surface of the first end plate and the second end plate.

6. The system as claimed in claim 3, wherein the first arrangement and the second arrangement comprise a series of protrusions extending from the surface of the first end plate and the second end plate.

7. The system as claimed in claim 6, wherein the protrusions are U-shaped members extending from the surface of the first end plate and the second end plate.

8. The system as claimed in claim 3, wherein each of the first end plate and the second end plate defines a set of connector holes, each connector hole on the first end plate or the second end plate positioned between adjacent locations indicated on said first end plate or said second end plate, each connector hole configured to receive a connecting member for connecting a first block of rebar assembly with a second block of rebar assembly.

9. The system as claimed in claim 1, wherein each of the first end plate and the second end plate defines a set of connector holes, wherein each of the connector holes are configured to receive a connecting member, wherein the connecting member is configured to connect a first of the block of rebar assembly with a second of the block of rebar assembly.

10. The system as claimed in claim 9, wherein the second end plate of the first of the block of rebar assembly and the first end plate of the second of the block of rebar assembly are connected to each other using the connecting member.

11. The system as claimed in claim 10, wherein the flow holes comprised in the second end plate of the block of rebar assembly and in the first end plate of the adjacent block of rebar assembly permit passage of concrete between the block of rebar assembly and the adjacent block of rebar assembly when the block of rebar assembly and the adjacent block of rebar assembly are connected to each other using the connecting member.

12. The system as claimed in claim 9, wherein at least one of the connector holes is configured to receive a reinforcing continuity member.

13. The system as claimed in claim 1, wherein the first end plate is larger compared to the second end plate.

* * * * *